US009759046B2

(12) United States Patent
Sanders

(10) Patent No.: US 9,759,046 B2
(45) Date of Patent: Sep. 12, 2017

(54) PIPE-IN-PIPE SHUNT TUBE ASSEMBLY

(75) Inventor: Michael Wayne Sanders, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 964 days.

(21) Appl. No.: 13/556,201

(22) Filed: Jul. 24, 2012

(65) Prior Publication Data

US 2014/0027115 A1 Jan. 30, 2014

(51) Int. Cl.
*E21B 43/04* (2006.01)
*E21B 43/08* (2006.01)

(52) U.S. Cl.
CPC ..... *E21B 43/04* (2013.01); *E21B 43/08* (2013.01)

(58) Field of Classification Search
CPC ..... E21B 43/04; E21B 43/08
USPC ..... 166/278, 51, 205
See application file for complete search history.

(56) References Cited

U.S. PATENT DOCUMENTS 5,868,200 A * 2/1999 Bryant ..... E21B 43/08 166/242.3
7,597,141 B2 * 10/2009 Rouse et al. ..... 166/227
9,097,104 B2 * 8/2015 Royer ..... E21B 41/0078
9,133,705 B2 * 9/2015 Angeles Boza ..... E21B 43/08
2006/0237197 A1 * 10/2006 Dale ..... E21B 43/04 166/378
2007/0044962 A1 * 3/2007 Tibbles ..... 166/278
2007/0084601 A1 4/2007 Wang et al.
2010/0236775 A1 9/2010 Sevre et al.
2010/0294495 A1 11/2010 Clarkson et al.
2011/0139465 A1 * 6/2011 Tibbles et al. ..... 166/387

OTHER PUBLICATIONS

Sanders, Michael W., International Application entitled, "Pipe-in-Pipe Shunt Tube Assembly", filed on Jun. 25, 2013, PCT Serial No. PCT/US13/47732.
Foreign Communication from a Related Counterpart Application, International Search Report and Written Opinion dated Sep. 23, 2013, International Application No. PCT/US13/47732, filed on Jun. 25, 2013.

* cited by examiner

*Primary Examiner* — David Andrews
*Assistant Examiner* — Tara Schimpf
(74) *Attorney, Agent, or Firm* — Scott Richardson; Baker Botts L.L.P.

(57) ABSTRACT

A shunt tube assembly comprises a wellbore tubular, a packing tube, a transport tube, at least one valve configured to provide selective fluid communication between an interior passageway through the transport tube and the packing tube. At least a portion of the transport tube is disposed within the packing tube.

18 Claims, 7 Drawing Sheets

PIPE-IN-PIPE SHUNT TUBE ASSEMBLY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the course of completing an oil and/or gas well, a string of protective casing can be run into the wellbore followed by production tubing inside the casing. The casing can be perforated across one or more production zones to allow production fluids to enter the casing bore. During production of the formation fluid, formation sand may be swept into the flow path. The formation sand tends to be relatively fine sand that can erode production components in the flow path. In some completions, the wellbore is uncased, and an open face is established across the oil or gas bearing zone. Such open bore hole (uncased) arrangements are typically utilized, for example, in water wells, test wells, and horizontal well completions.

When formation sand is expected to be produced along with any oil, gas, and/or water, one or more sand screens may be installed in the flow path between the production tubing and the perforated casing (cased) and/or the open wellbore face (uncased). A packer is customarily set above the sand screen to seal off the annulus in the zone where production fluids flow into the production tubing. The annulus around the screen can then be packed with a relatively coarse sand, gravel, and/or proppant which acts as a filter to reduce the amount of fine formation sand reaching the screen. The packing sand is pumped down the work string in a slurry of water and/or gel and fills the annulus between the sand screen and the well casing. In well installations in which the screen is suspended in an uncased open bore, the sand or gravel pack may serve to support the surrounding unconsolidated formation.

During the sand packing process, annular sand "bridges" can form around the sand screen that may prevent the complete circumscribing (e.g., complete filling of the annulus between the wellbore/casing and the sand screen) of the screen structure with packing sand in the completed well. This incomplete screen structure coverage by the packing sand may leave an axial portion of the sand screen exposed to the fine formation sand, thereby undesirably lowering the overall filtering efficiency of the sand screen structure and possibly providing an entry point for the sand into the production tubing in the case that the produced fluids/and erode a hole in the screen.

One conventional approach to overcoming this packing sand bridging problem has been to provide each generally tubular filter section with a series of shunt tubes that longitudinally extend through the filter section, with opposite ends of each shunt tube projecting outwardly beyond the active filter portion of the filter section. In the assembled sand screen structure, the shunt tube series are axially joined to one another to form a shunt path extending along the entire length of the sand screen structure. The shunt path operates to permit the inflowing packing sand/gel slurry to bypass any sand bridges that may be formed and permit the slurry to enter the screen/casing annulus beneath a sand bridge, thereby forming the desired sand pack beneath it.

SUMMARY

In an embodiment, a shunt tube assembly comprises a wellbore tubular, a packing tube, a transport tube, at least one valve configured to provide selective fluid communication between an interior passageway through the transport tube and the packing tube. At least a portion of the transport tube is disposed within the packing tube.

In an embodiment, a method of gravel packing comprises passing a slurry through a transport tube, passing the slurry from the transport tube to an annulus between the transport tube and a packing tube, and disposing the slurry about a sand screen assembly. The slurry passes through at least one valve disposed in the transport tube when passing from the transport tube to the annulus.

In an embodiment, a method comprises passing a fluid through a first wellbore tubular. The first wellbore tubular is disposed within a second wellbore tubular, and an annulus is formed between the first wellbore tubular and the second wellbore tubular. The method also comprises passing the fluid from the first wellbore tubular to the annulus, where the fluid passes through at least one valve disposed in the first wellbore tubular when passing from the first wellbore tubular to the annulus, passing the fluid from the annulus to an exterior of the second wellbore tubular through one or more ports disposed in the second wellbore tubular, and closing the at least one valve in response to a portion of the fluid passing through the at least one valve.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
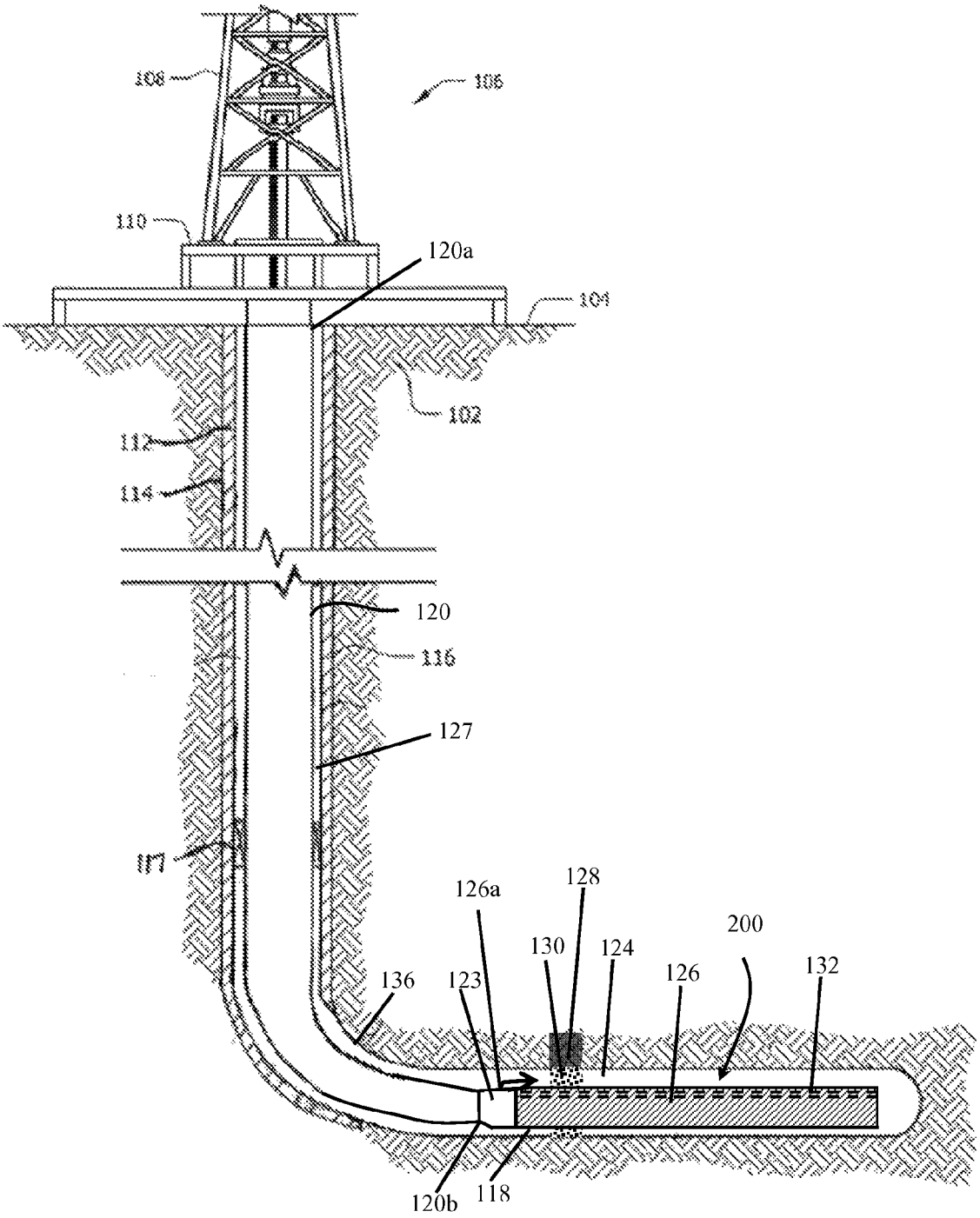
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal," "longitudinally," "axial," or "axially" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

Shunt tube assemblies for use with a sand screen assembly generally comprise one or more tubular structures comprising transport tubes and/or packing tubes. The transport tubes generally extend along the length of the shunt tube assembly and serve to provide a fluid pathway for the sand slurry. The packing tubes generally branch off of the transport tubes along the length of the sand screen assembly and have one or more openings or nozzles to allow the sand slurry to exit the shunt tubes assembly to pack an annulus between the well screen assembly and the wellbore/casing wall. The shunt tube assemblies may be disposed on the exterior of a work string and may be subject to snaring or rupturing against an inner surface of the wellbore as the work string is being run into the wellbore during well completion. These shunt tube assemblies may also occupy space within the wellbore along the production tubing.

In order to mitigate the danger of being damaged during conveyance within the wellbore, the shunt tube assembly disclosed herein provides a system and method for minimizing the number of shunt tubes exposed to the walls of the wellbore such as to protect the shunt tube assembly during installation. For instance, the shunt tubes forming the shunt tube assembly may be nested or otherwise disposed in a pipe-in-pipe configuration, where a central axis of an inner transport tube may be positioned either concentrically or eccentrically with respect to a central axis of an outer packing tube. In this arrangement with transport tubes disposed within packing tubes, the total number of exposed tubes along the sand screen assembly may be reduced, lessening the risk of damaging the assembly during installation.

In order to reduce the risk of premature dehydration of the slurry within the pipe-in-pipe shunt tube assembly disclosed herein, the shunt tube assembly comprises a system for preventing or reducing the leakoff of fluid within the slurry to the exterior of the shunt tubes as the slurry is flowed through the shunt tube assembly. For instance, the transport tube of the shunt tube assembly described herein may be equipped with one or more ports or valves that may close after an amount of slurry has flowed through them, preventing or at least reducing additional leakoff of fluid to the formation through the closed valves.

Referring to FIG. 1, an example of a wellbore operating environment in which a shunt tube assembly may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore 114 may be a new wellbore, an existing wellbore, a straight wellbore, an extended reach wellbore, a sidetracked wellbore, a multilateral wellbore, and other types of wellbores for drilling and completing one or more production zones. Further, the wellbore may be used for both producing wells and injection wells. The wellbore 114 may also be used for purposes other than hydrocarbon production such as geothermal recovery and the like.

A wellbore tubular 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a work string having a first end 120*a* disposed at the surface 104 and a second end 120*b* disposed within horizontal section 118 of wellbore 114. Wellbore tubular 120 may comprise a cross-over tool 123 disposed within wellbore 114 and coupled to second end 120*b*, and a well screen assembly 126 disposed in the wellbore 114 and coupled to cross-over tool 123. It should be understood that the wellbore tubular 120 is equally applicable to any type of wellbore tubulars being inserted into a wellbore including as non-limiting examples drill pipe, and/or casing liners. Further, the wellbore tubular 120 may operate in any of the wellbore orientations (e.g., vertical, deviated, horizontal, and/or curved) and/or types described herein. In an embodiment, the wellbore may comprise wellbore casing 112, which may be cemented into place in at least a portion of the wellbore 114.

In an embodiment, the wellbore tubular 120 may comprise a completion assembly string comprising one or more downhole tools (e.g., zonal isolation devices 117, cross-over tool 123, screen assembly 126, valves, etc.). The one or more downhole tools may take various forms. For example, a zonal isolation device 117 may be used to isolate the various zones within a wellbore 114 and may include, but is not limited to, a packer (e.g., production packer, gravel pack packer, frac-pac packer, etc.), an annulus safety valve, or the like. The cross-over tool 123 generally provides fluid communication between the interior of the well screen assembly and the annulus 127 while also providing fluid communication between the annulus 124 and the interior of the wellbore tubular 120. While FIG. 1 illustrates a single screen assembly 126, the wellbore tubular 120 may comprise a plurality of screen assemblies 126. The zonal isolation devices 117 may be used between various ones of the screen assemblies 126, for example, to isolate different gravel pack zones or intervals along the wellbore 114 from each other.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

In use, the screen assembly 126 can be positioned in the wellbore 114 as part of the wellbore tubular string 120 adjacent a hydrocarbon bearing formation. An annulus 124 is formed between the screen assembly 126 and the wellbore 114. The gravel slurry may travel within the wellbore tubular 120, through cross-over tool 123, and into annulus 124 between the well screen assembly 126 and the wellbore 114 wall as it is pumped down the wellbore around the screen assembly 126. Upon encountering a section of the subterranean formation 102 including an area 128 of highly permeable material, the highly permeable area 128 can draw liquid from the slurry, thereby dehydrating the slurry. As the slurry dehydrates in the permeable area 128, the remaining solid particles may form a sand bridge 130 and prevent further filling of the annulus 124 with gravel. One or more shunt tubes 132 may be used to create an alternative path for gravel around the sand bridge 130. The shunt tubes 132 may allow a slurry of sand to enter an apparatus and travel in the shunt tubes 132 past the sand bridge 130 to reenter the annulus 124 downstream of the sand bridge 130. The shunt tubes 132 may be placed on the outside of the wellbore tubular 120 or run along the interior thereof. Fluid from the dehydrated gravel slurry 126*a* may enter assembly 126 and pass to the surface 104 through the annulus 127.

Figure 2:
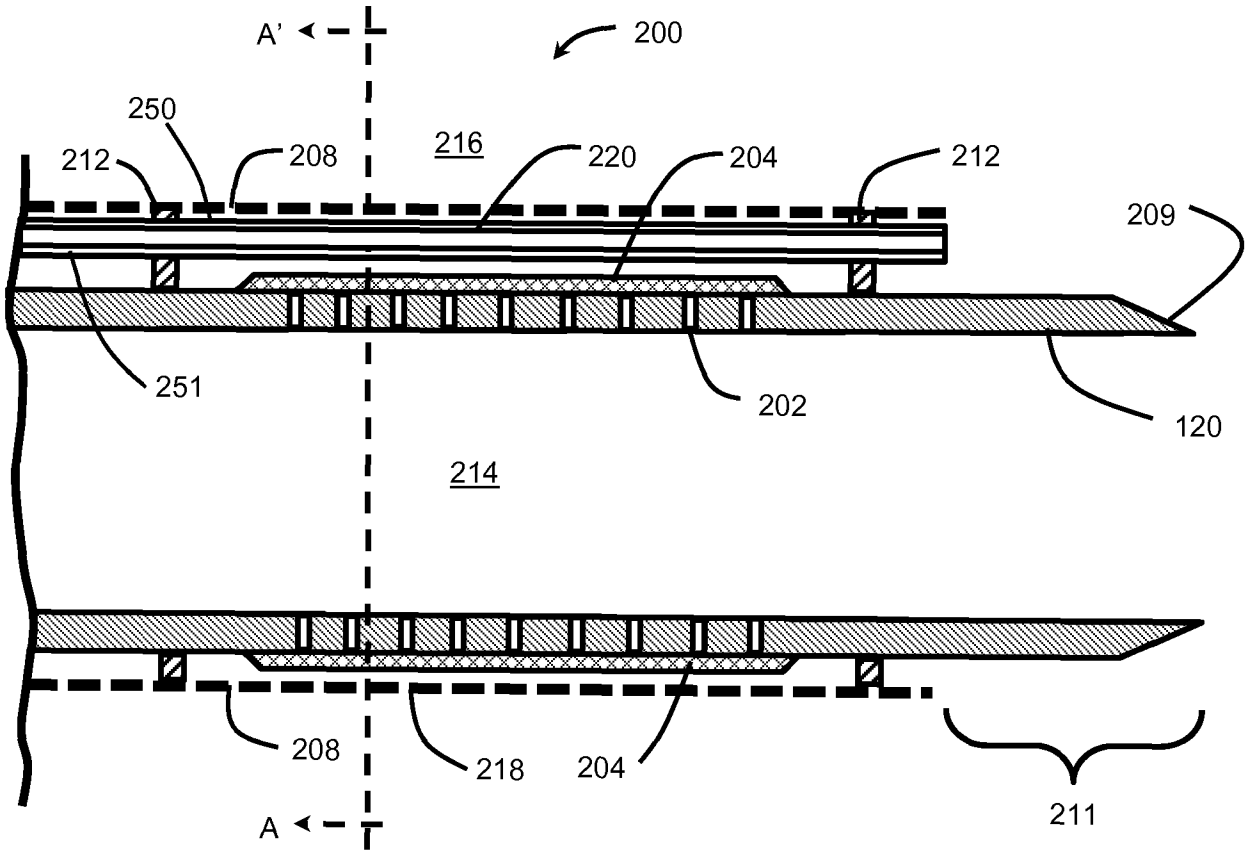
FIG. 2 is a cross-sectional view of an embodiment of a shunt tube assembly.

FIG. 2 illustrates a cross-sectional view of an embodiment of a wellbore tubular comprising a shunt tube assembly 200 disposed along its length. The wellbore tubular 120 generally comprises a series of perforations 202 disposed therethrough. A filter media 204 may be disposed about the wellbore tubular 120 and the series of perforations 202 to screen the incoming fluids from the formation. The shunt tube assembly 200 may comprise one or more retaining rings 212 and one or more shunt tubes 220, 250 disposed along and generally parallel to the wellbore tubular 120. An outer body member 208 may be disposed about the wellbore tubular 120, one or more shunt tubes 220, 250, and/or the filter media 204. In an embodiment, the retaining rings 212 are configured to retain the one or more shunt tubes 220, 250 and/or outer body member 208 in position relative to the wellbore tubular 120. The shunt tube assembly 200 may comprise one or more packing tubes 250 having a transport tube disposed therethrough.

The wellbore tubular 120 comprises the series of perforations 202 through the wall thereof. The wellbore tubular 120 may comprise any of those types of wellbore tubular described above with respect to FIG. 1. While the wellbore tubular 120 is illustrated as being perforated in FIG. 2, the wellbore tubular 120 may be slotted and/or include perforations of any shape so long as the perforations permit fluid communication of production fluid between an interior throughbore 214 and an exterior 216 of the shunt tube assembly 200.

The wellbore tubular 120 may generally comprise a pin end 209 and a box end to allow the wellbore tubular 120 to be coupled to other wellbore tubulars having corresponding connections. As can be seen in FIG. 2, the wellbore tubular 120 may have a coupling section 211 that extends beyond the shunt tube assembly 200. The coupling section 211 of the wellbore tubular 120 may be used during the coupling process to allow one or more tools to engage the exposed portion 211 and thread the joint to an adjacent joint of wellbore tubular. In an embodiment, the exposed portion may be about 1 to 5 feet, or alternatively about 2 feet to about 4 feet, though any distance suitable for allowing the wellbore tubular 120 to be coupled to an adjacent joint of wellbore tubular may be used.

The filter media 204 may be disposed about the wellbore tubular 120 and can serve to limit and/or prevent the entry of sand, formation fines, and/or other particular matter into the wellbore tubular 120. In an embodiment, the filter media 204 is of the type known as "wire-wrapped," since it is made up of a wire closely wrapped helically about a wellbore tubular 120, with a spacing between the wire wraps being chosen to allow fluid flow through the filter media 204 while keeping particulates that are greater than a selected size from passing between the wire wraps. While a particular type of filter media 204 is used in describing the present invention, it should be understood that the generic term "filter media" as used herein is intended to include and cover all types of similar structures which are commonly used in gravel pack well completions which permit the flow of fluids through the filter or screen while limiting and/or blocking the flow of particulates (e.g. other commercially-available screens, slotted or perforated liners or pipes; sintered-metal screens; sintered-sized, mesh screens; screened pipes; prepacked screens and/or liners; and/or combinations thereof).

As illustrated in FIG. 2, the shunt tubes 220, 250, outer body member 208, and/or in some embodiments, the shunt tubes 220, 250 can be retained in position relative to the wellbore tubular 120 using the retaining rings 212. The retaining rings 212 generally comprise rings and/or clamps configured to engage and be disposed about the wellbore tubular 120. The retaining ring 212 may engage the wellbore tubular using any suitable coupling including, but not limited to, corresponding surface features, adhesives, curable components, welds, any other suitable retaining mechanisms, and any combination thereof. For example, the inner surface of the retaining ring 212 may comprise corrugations, castellations, scallops, and/or other surface features. The corresponding outer surface of the wellbore tubular 120 may comprise corresponding surface features that, when engaged, couples the retaining rings 212 to the wellbore tubular 120.

To protect the transport tubes 220, packing tubes 250, and/or filter media 204 from damage during installation of the screen assembly comprising the shunt tube assembly 200 within the wellbore, the outer body member 208 may be positioned about a portion of the shunt tube assembly 200. The outer body member 208 comprises a generally cylindrical member formed from a suitable material (e.g. steel) that can be secured at one or more points to the wellbore tubular 120. The outer body member 208 may have a plurality of openings 218 (only one of which is numbered in FIG. 2) through the wall thereof to provide an exit for fluid (e.g., gravel slurry) to pass out of the outer body member 208 as it flows out of one or more openings in the transport tubes 220 and/or packing tubes 250, and/or an entrance for fluids into the outer body member 208 and through the permeable section of the filter media 204 during production. By positioning the outer body member 208 over the shunt tube assembly 200, the transport tubes 220, packing tubes 250, and/or filter media 204 may be protected from any accidental impacts during the assembly and installation of the screen assembly in the wellbore that might otherwise severely damage or destroy one or more components of the screen assembly or the shunt tube assembly 200.

Figure 3B:
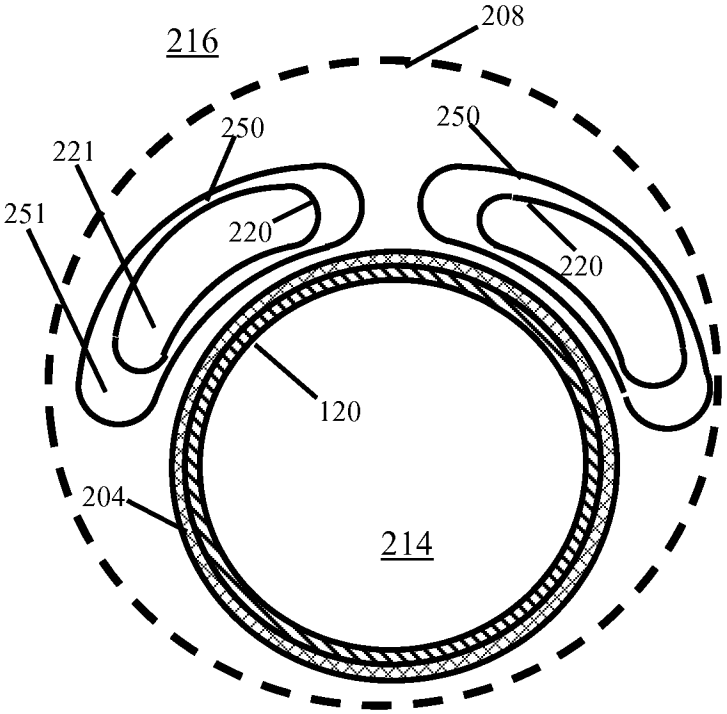
FIGS. 3A and 3B are cross-sectional views of embodiments of a shunt tube assembly along line A-A' of FIG. 2.
Figure 3A:
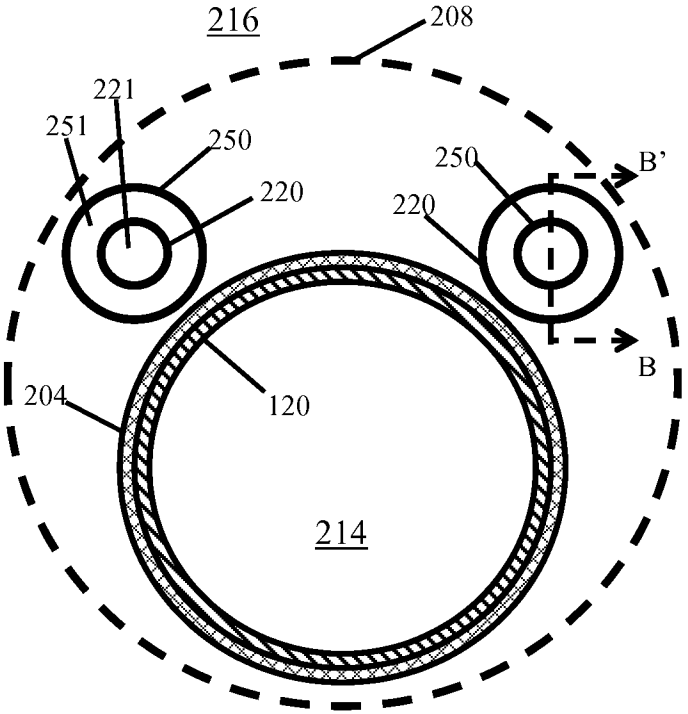

In an embodiment, the shunt tube assembly 200 generally comprises a pipe-in-pipe configuration. The shunt tubes 220, 250 may comprise transport tubes 220 and/or packing tubes 250, and the transport tubes 220 may be disposed within and in fluid communication with one or more packing tubes 250. As illustrated in FIGS. 2, 3A, and 3B, the transport tubes 220 may be disposed within the packing tubes 250, and the packing tubes 250 having the transport tubes 220 disposed therein may be retained in position relative to the wellbore tubular 120 by the retaining rings 212. An annulus 251 formed between the transport tube 220 and the packing tube 250 may be in fluid communication with the interior flowbore 221 of the transport tube 220 through a series of ports or valves disposed in the transport tube 220. Various configurations for providing fluid communication between the interior of the one or more shunt tubes 220, 250 and the exterior 216 of the outer body member 208 are possible.

FIGS. 3A and 3B illustrate embodiments of shunt tube assembly 200 as shown with a cross-sectional view along line A-A' of FIG. 2. The one or more shunt tubes 220, 250, as described in more detail herein, generally comprise tubular members disposed outside of and generally parallel to the wellbore tubular 120, though other positions and alignments may be possible. While described as tubular members, the one or more shunt tubes 220, 250 may have cross-sectional shapes other than cylindrical and may generally be rectangular, elliptical, kidney shaped, and/or trapezoidal in cross-section. In an embodiment, transport tubes 220 and/or packing tubes 250 may be configured to inflate and/or change their cross-sectional shape in response to having a slurry or fluid pumped through them. In an embodiment, a plurality of shunt tube assemblies 200 may extend along the length of the screen assembly 126. The use of a plurality of pipe-in-pipe structures may provide redundancy to the shunt tubes system in the event that one of the shunt tube assemblies is damaged, clogged, or otherwise prevented from operating as intended.

The one or more shunt tube assemblies 200 may be eccentrically aligned with respect to the wellbore tubular 120 as best seen in FIGS. 3A and 3B. In this embodiment, two packing tubes 250, each having a transport tube 220 disposed therein, are arranged to one side of the wellbore tubular 120 within the outer body member 208. While illustrated in FIGS. 2 and 3 as having an eccentric alignment, other alignments of the one or more shunt tubes 220, 250 with respect to the wellbore tubular 120 may also be possible.

In an embodiment, the flow area available for the slurry to travel along the length of the shunt tube assembly 200 may comprise the cross-sectional area through the transport tube 220. Over at least a portion of the length of the shunt tube assembly 200, the cross-sectional area of the annulus (e.g., the cross-sectional area of the packing tube 250 minus the cross-sectional area within the outer diameter of the transport tube 220) may provide a flow area for the slurry to travel axially to one or more ports in the packing tube 250 to pack an area adjacent to the shunt tube assembly 200 and the screen assembly. The ratio of the cross-sectional area of the transport tube 220 to the cross-sectional area of the annulus 251 may be selected to provide for the desired flow rates and areas. In an embodiment, the ratio of the cross-sectional area of the transport tube 220 to the cross-sectional area of the annulus 251 may range from about 90:10 to about 50:50, or from about 80:20 to about 60:40.

In use, the pipe-in-pipe configuration of the transport tubes 220 and the packing tubes 250 may provide the fluid pathway for a slurry to be diverted around a sand bridge. Upon the formation of a sand bridge, a back pressure generated by the blockage may cause the slurry carrying the sand to be diverted through the transport tubes 220 until bypassing the sand bridge. The slurry may then pass out of the transport tubes 220 through one or more ports or valves and into an annulus formed between the transport tubes 220 and packing tubes 250. The slurry may pass through one or more ports in the packing tubes 250 to form a gravel pack about the screen assembly.

Figure 4A:
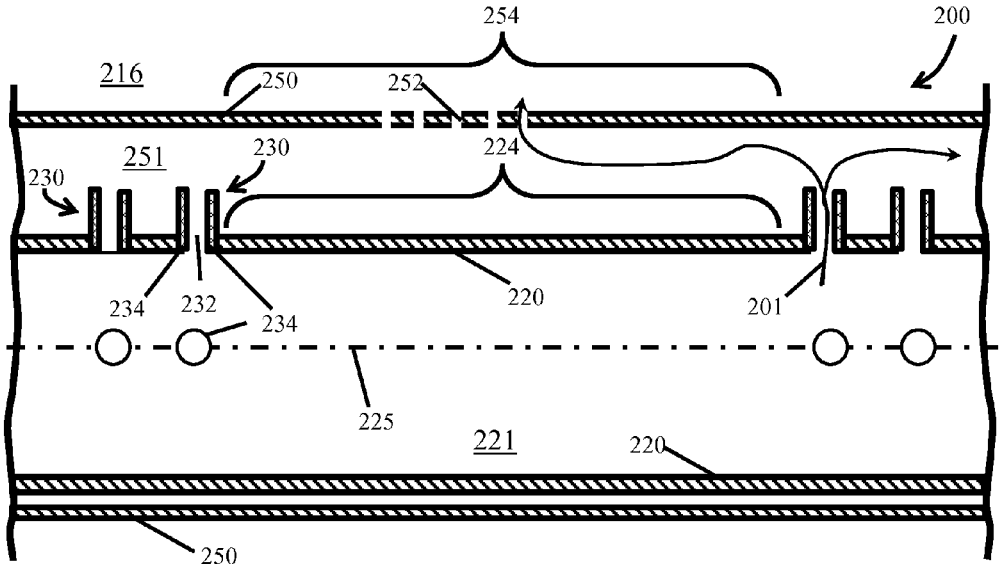
FIGS. 4A and 4B are cross-sectional views of embodiments of the transport tube and packing tube of FIG. 3A along line B-B'.
Figure 4B:
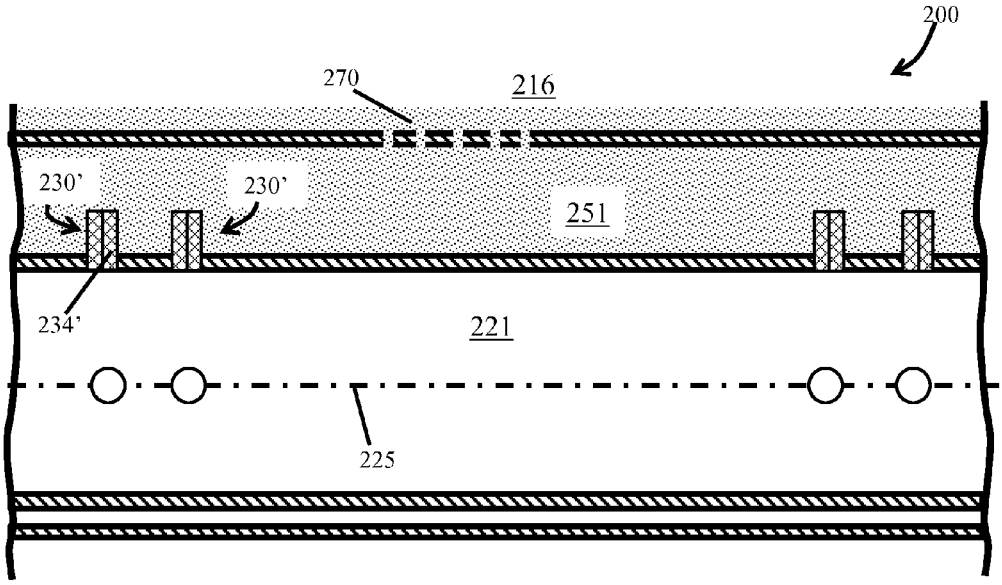

FIGS. 4A and 4B illustrate an embodiment of a shunt tube assembly 200 as shown with a cross-sectional view along line B-B' of FIG. 3A. The transport tube 220 of shunt tube assembly 200 can be disposed eccentrically within packing tube 250. When disposed within horizontal sections of a wellbore (e.g., horizontal section 118 of the wellbore 114 of FIG. 1), the force of gravity on the transport tube 220 may position the transport tube 220 eccentrically within the packing tube 250. In some embodiments, an internal alignment ring may be used to maintain a concentric or eccentric alignment of the transport tube 220 within the packing tube 250, as described in more detail herein. In order to provide fluid communication with the exterior of the packing tubes, the packing tube 250 may comprise one or more ports 252 that are configured to provide fluid communication between the annulus 251 and exterior 216. The one or more ports 252 may comprise openings of various shapes such as opening comprising circular, oval, elliptical, oblong, square, rectangular, or slotted cross-sections. In some embodiments, one or more nozzles may be disposed at any suitable angle within the one or more ports 252. The one or more ports 252 may be disposed over the length of the packing tube 250 or at intervals along its length. In an embodiment, the one or more ports 252 may be separated by solid sections 254 that extend axially between sections of the packing tube 250 comprising the one or more ports 252. The one or more ports 252 may also be disposed about the circumference of the packing tube 250 to provide fluid communication between the annulus 251 and the exterior 216 of the packing tube 250.

In the embodiment, the transport tube 220 of shunt tube assembly 200 may comprise one or more valves 230. The valves 230 may be configured to allow for selective fluid communication between passageway 221 of the transport tube 220 and annulus 251 of the packing tube 250. For instance, the valves 230 may be configured to allow for an amount of fluid to flow via a fluid flowpath 201 between passageway 221 and annulus 251 before substantially closing to limit and/or prevent flow between passageway 221 and annulus 251. Once the slurry passes to the annulus 251, the slurry may flow in the direction of least resistance towards any port 252 in fluid communication with the annulus 251 and available to receive the slurry (e.g., having a void available for receiving the slurry about the screen assembly). The valves 230 may be disposed over the length of the transport tube 220 or at intervals along its length. In an embodiment, the valves 230 may be separated by solid sections 224 that extend axially between sections of the transport tube 220 comprising the one or more valves 230. The one or more valves 230 may also be disposed about the circumference of the transport tube 220 to provide fluid communication with the annulus 251.

In an embodiment, the valve 230 comprises a swellable material disposed on an inner surface of a fluid passage that is configured to swell in response to contacting a suitable fluid and substantially close the fluid passage. In an embodiment, the valve 230 may comprise a bore 232 that extends through the wall of the transport tube at any suitable angle. The bore 232 may extend through a tubular wall 234 extending through the transport tube 220. A liner may be disposed on an inner surface of the tubular wall 234 that comprises a material that is configured to swell in response to contact with a suitable fluid (e.g., water, oil, etc.). In some embodiments, the tubular wall 234 may itself comprise a material that is configured to swell in response to contact with a suitable fluid.

The material that is configured to swell may comprise any swellable material configured to swell upon contact with an aqueous fluid, a hydrocarbon, and/or any other inorganic or organic fluid. In an embodiment, the swellable material is configured to swell in response to being contacted with a fluid in the sand slurry passing through the valves in the transport tube. In some embodiments, various pad fluids, pre-flush fluids, and/or post-flush fluids can be used before, during, and/or after the introduction of the sand slurry to cause the swellable material to swell. The swellable material may be configured to swell in the presence of a variety of fluids to allow for the restriction of flow through the one or more valves in response to one or more fluids flowing through the valves.

The swellable material may be formed from one or more materials that swell when contacted by a suitable fluid. For example, the swellable material may comprise a polymer that swells multiple times its initial size upon being contacted with a suitable fluid. In an embodiment, the swellable material comprises a material that swells upon contact with and/or absorption of a hydrocarbon, such as an oil or a gas. The hydrocarbon may be absorbed into the swellable material such that the volume of the swellable material increases, creating expansion of the swellable material. In an embodiment, the swellable material may swell until its inner surface substantially closes the flow bore through the one or more valves. The swellable material accordingly provides the closure mechanism for the one or more valves. In an embodiment, suitable swellable materials may include, but are not limited to, elastic polymers, such as EPDM rubber, styrene butadiene, natural rubber, ethylene propylene monomer rubber, ethylene propylene diene monomer rubber, ethylene vinyl acetate rubber, hydrogenized acrylonitrile butadiene rubber, acrylonitrile butadiene rubber, isoprene rubber, chloroprene rubber, polynorbornene, and any combination thereof. These and other swellable materials can swell in contact with and by absorption of hydrocarbons so that the swellable material expands. In an embodiment, the rubber of the swellable materials may also have other materials dissolved in or in mechanical mixture therewith, such as various fibers. Additional options may be rubber in mechanical mixture with polyvinyl chloride, methyl methacrylate, acrylonitrile, ethylacetate, and/or other polymers that expand in contact with a hydrocarbon.

In an embodiment, the swellable material may comprise a material that swells upon contact with water. In this case, the swellable material may comprise a water-swellable polymer such as a water-swellable elastomer or water-swellable rubber. More specifically, the swellable material may comprise a water-swellable hydrophobic polymer or water-swellable hydrophobic copolymer and preferably a water-swellable hydrophobic porous copolymer. Other polymers useful in accordance with the present invention can be prepared from a variety of hydrophilic monomers and hydrophobically modified hydrophilic monomers. Examples of suitable hydrophilic monomers which can be utilized include, but are not limited to, acrylamide, 2-acrylamido-2-methyl propane sulfonic acid, N,N-dimethylacrylamide, vinyl pyrrolidone, dimethylaminoethyl methacrylate, acrylic acid, trimethylammoniumethyl methacrylate chloride, dimethylaminopropylmethacrylamide, methacrylamide and hydroxyethyl acrylate.

A variety of hydrophobically modified hydrophilic monomers can also be utilized to form the polymers useful in accordance with this invention. Suitable hydrophobically modified hydrophilic monomers may include, but are not limited to, alkyl acrylates, alkyl methacrylates, alkyl acrylamides and alkyl methacrylamides wherein the alkyl radicals have from about 4 to about 22 carbon atoms, alkyl dimethylammoniumethyl methacrylate bromide, alkyl dimethylammoniumethyl methacrylate chloride and alkyl dimethylammoniumethyl methacrylate iodide wherein the alkyl radicals have from about 4 to about 22 carbon atoms and alkyl dimethylammonium-propylmethacrylamide bromide, alkyl dimethylammonium propylmethacrylamide chloride and alkyl dimethylammonium-propylmethacrylamide iodide wherein the alkyl groups have from about 4 to about 22 carbon atoms, and any combination thereof.

Suitable polymers can be prepared by polymerizing any one or more of the described hydrophilic monomers with any one or more of the described hydrophobically modified hydrophilic monomers. The polymerization reaction can be performed in various ways that are known to those skilled in the art, such as those described in U.S. Pat. No. 6,476,169 which is hereby incorporated by reference for all purposes. Suitable polymers may have estimated molecular weights in the range of from about 100,000 to about 10,000,000 and preferably in the range of from about 250,000 to about 3,000,000 and may have mole ratios of the hydrophilic monomer(s) to the hydrophobically modified hydrophilic monomer(s) in the range of from about 99.98:0.02 to about 90:10.

Additional suitable polymers may include, but are not limited to, hydrophobically modified polymers, hydrophobically modified water-soluble polymers and hydrophobically modified copolymers thereof. Particularly suitable hydrophobically modified polymers include, but are not limited to, hydrophobically modified polydimethylaminoethyl methacrylate, hydrophobically modified polyacrylamide and hydrophobically modified copolymers of dimethylaminoethyl methacrylate and vinyl pyrollidone. As still another example, the swellable material may be a salt polymer such as polyacrylamide or modified crosslinked poly(meth)acrylate that has the tendency to attract water from salt water through osmosis wherein water flows from an area of low salt concentration, the formation water, to an area of high salt concentration, the salt polymer, across a semi permeable membrane, the interface between the polymer and the production fluids, that allows water molecules to pass therethrough but prevents the passage of dissolved salts therethrough.

Referring now to FIG. 4B, once the slurry 270 has passed through bores 232 of valves 230 (e.g., bores 232 of valves 230 as shown in FIG. 4A), the swellable material may expand to form valves 230'. Due to the expansion of walls 234' and or liners, fluid communication between passageway 221 of the transport tube 220 and annulus 251 may be prevented or at least substantially restricted. As shown in FIG. 4B, at the time when valves 230' have been closed, a volume of slurry 270 may be disposed about the sealed valves 230' in annulus 251 and in the exterior 216 of the shunt tubes, forming a gravel pack within the exterior 216 at that particular location within the wellbore (e.g., wellbore 114 of FIG. 1). Due to the restriction of flow between passageway 221 and annulus 251, any fluid within slurry flowed through passageway 221 may be restricted from leaking off into an adjacent portion of the formation via fluid communication between passageway 221 and the exterior 216. Thus, slurry within passageway 221 may continue to flow through passageway 221 without becoming dehydrated through excessive fluid leak off of the slurry fluid into the adjacent formation. Further, the ability to communicate the slurry farther downhole may in turn allow for the successful gravel packing of a longer section of wellbore (e.g., a longer section of horizontal section 118 of the wellbore 114 of FIG. 1).

Figure 5A:
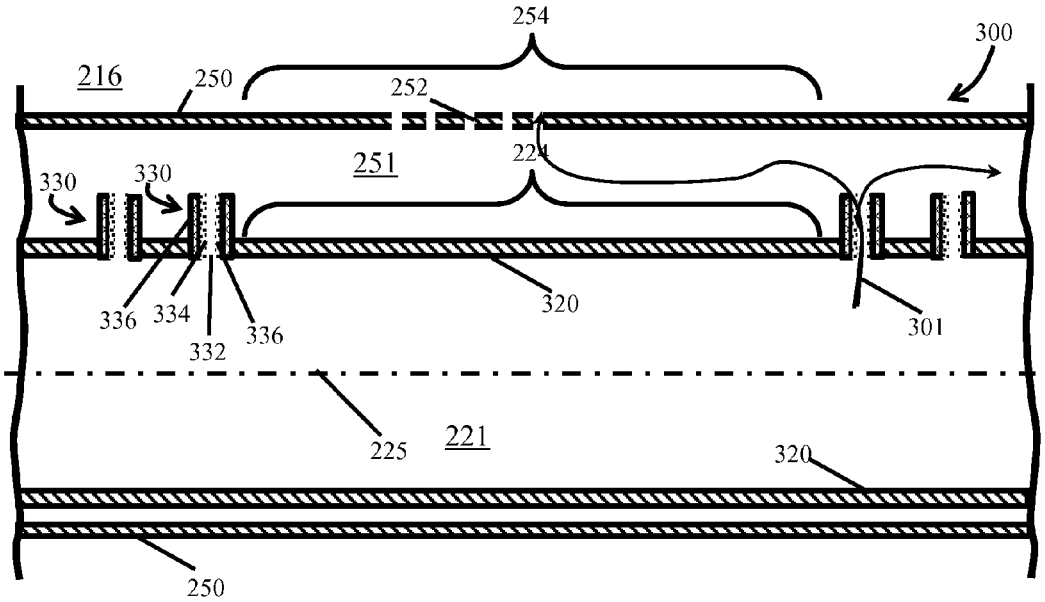
FIGS. 5A and 5B are cross-sectional views of embodiments of the transport tube and packing tube of FIG. 3A along line B-B'.
Figure 5B:
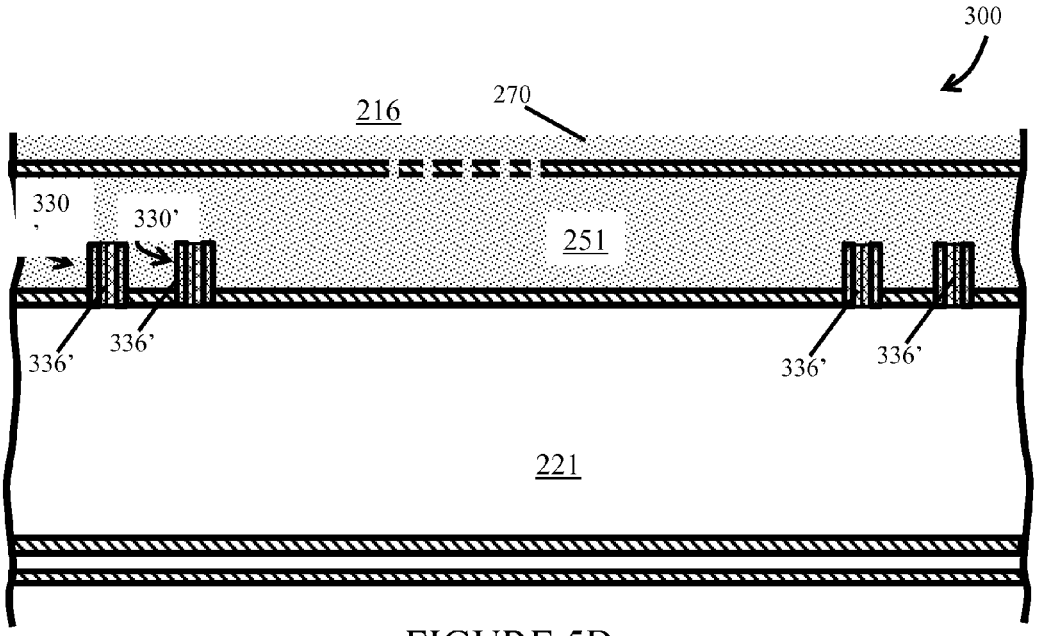

FIGS. 5A and 5B illustrate another embodiment of a shunt tube assembly as shown with a cross-sectional view along line B-B' of FIG. 3A. A shunt tube assembly 300 includes a transport tube 320 having central passageway 221 and central axis 225, and the transport tube 320 is disposed within the packing tube 250. While illustrated as being disposed eccentrically within the packing tube 250, the transport tube 320 may also be disposed concentrically within the packing tube 250. The packing tube 250 may comprise one or more ports 252 as described in more detail with respect to FIGS. 4A and 4B.

The transport tube 320 is in fluid communication with the packing tube 250 via one or more valves 330 disposed in a wall of the transport tube 320. The valves 330 may be configured to allow for selective fluid communication between the central passageway 221 of the transport tube 320 and the annulus 251. The valves 330 may be similar to the valves described with respect to FIGS. 4A and 4B, and any of the shapes and locations of the valves described with respect to the valves 230 may also apply to the valves 330. In an embodiment, the valve 330 may comprises a bore 332 that extends through the wall of the transport tube at any suitable angle. The bore 332 may extend through a tubular wall 336 extending through the transport tube 320. The tubular wall 336 may comprise a material that is configured to swell in response to contact with fluid, and/or a liner may be disposed on an inner surface of the tubular wall 336 that comprises a material that is configured to swell in response to contact with a suitable fluid. The material and the corresponding suitable fluid may comprise any of the swellable materials and fluids described above with respect to FIGS. 4A and 4B.

In an embodiment, one or more coatings may be disposed on an interior surface 334 of the swellable material in the valve, and the coating may be configured to erode and/or at least partially dissolve in response to contacting an abrasive element and/or a fluid, such as the slurry. The one or more coatings may be used to isolate the swellable material from the fluid in the slurry until the coating is removed, thereby delaying the closing of the valve. In an embodiment, the coating may be disposed over at least a portion of the swellable material exposed to fluid. The one or more coatings can be designed to erode, disperse, dissolve, or otherwise permit contact between the swellable material and a fluid when desired. The coating may comprise a metal layer, paint, organic and/or inorganic polymers, oxidic coating, graphitic coating, elastomers, or any combination thereof which erodes, disperses, dissolves and/or degrades either physically, thermally, photo-chemically, bio-chemically and/or chemically, when contacted with a suitable stimulus, such as a suitably abrasive fluid flow, external heat, and/or a suitable chemical (such as a solvent including, but not limited to, aliphatic, cycloaliphatic, and/or aromatic hydrocarbons, etc.). In an embodiment, suitable materials used to form the one or more coatings may include a metal layer. Suitable metals may include, but are not limited to, barium, calcium, sodium, magnesium, aluminum, manganese, zinc, chromium, iron, cobalt, nickel, tin, any alloy thereof, or any combination thereof. In some embodiments, the plug may comprise various polymeric compounds configured to erode and/or dissolve in the presence of a suitable fluid.

Suitable fluids configured to at least partially erode and/or dissolve the one or more coatings may comprise one or more erosive components such as particulates (e.g., sand and/or gravel used with forming a sand screen). The particulates may erode the one or more coatings to allow a fluid to contact the swellable material. In some embodiments, the one or more coatings may alternatively or additionally at least partially dissolve in response to being contacted by a suitable fluid. The fluid may be introduced before, during, and/or after the sand slurry passes through the valves. In an embodiment, any fluid comprising a suitable chemical capable of dissolving at least a portion of the one or more coatings may be used. The chemical may comprise an acid, an acid generating component, a base, a base generating component, and any combination thereof. Examples of acids that may be suitable may include, but are not limited to organic acids (e.g., formic acids, acetic acids, carbonic acids, citric acids, glycolic acids, lactic acids, ethylenediaminetetraacetic acid (EDTA), hydroxyethyl ethylenediamine triacetic acid (HEDTA), and the like), inorganic acids (e.g., hydrochloric acid, hydrofluoric acid, nitric acid, sulfuric acid, phosphonic acid, p-toluenesulfonic acid, and the like), and combinations thereof. Examples of acid generating compounds may include, but are not limited to, polyamines, polyamides, polyesters, and the like that are capable of hydrolyzing or otherwise degrading to produce one or more acids in solution (e.g., a carboxylic acid, etc.). Examples of suitable bases may include, but are not limited to, sodium hydroxide, potassium carbonate, potassium hydroxide, sodium carbonate, and sodium bicarbonate. In some embodiments, additional suitable chemicals can include a chelating agent, an oxidizer, or any combination thereof. One of ordinary skill in the art with the benefit of this disclosure will recognize the suitability of the chemical used with the fluid to dissolve at least a portion of the coating based on the composition of the coating and the conditions within the wellbore.

The selection of the materials for the one or more coatings and the fluid intended to at least partially dissolve the coating may be used to determine the rate at which the coating, or at least a portion of the coating, dissolves.

Further factors affecting the rate of dissolution include the characteristics of the wellbore environment including, temperature, pressure, flow characteristics around the coating, and the concentration of the chemical in the fluid in contact with the coating. These factors may be manipulated to provide a desired time delay before the coating is dissolved and a fluid may contact the swellable material.

As the slurry flows through passageway 221 and bores 332 via a flowpath 301, friction between the slurry and interior surfaces 334 may lead to the erosion and/or dissolution of coating, thereby exposing the swellable material to fluid within the slurry. The swellable material may then swell and restrict fluid flow through the bores 332. Depending on the selection of the one or more coatings on the interior surfaces 334, varying quantities of predetermined slurry may flow through bores 332 before erosion and/or dissolution of surfaces 334 exposes the swellable material to the slurry. For instance, a more easily erodible material for surfaces 334 may be selected to provide for faster erosion, reducing the amount of slurry passing through bores 332 prior to exposure of the swellable material to the slurry.

Referring now to FIG. 5B, once an amount of fluid and/or slurry has passed through bores 332 of valves 330, eroding and/or dissolving the one or more coatings on interior surfaces 334, the swellable material comprising walls 336 of valves 330 may expand to restrict further fluid flow through valves 330'. Due to the expansion of walls 336' into bores 332, fluid communication between passageway 221 of the transport tube 320 and annulus 251 of packing tube 250 may be substantially restricted. When flow through valves 330' has been restricted, a volume of slurry gravel 270 may be disposed about the sealed valves 330' in annulus 251 and in the exterior 216, forming a gravel pack within the exterior 216 at that particular location within the wellbore (e.g., wellbore 114 of FIG. 1). In this embodiment, the inclusion of the one or more coatings on the interior surfaces 334 may delay the expansion of the swellable materials into bores 332, allowing for a quantity of slurry to flow through bores 332 along flowpath 301 before flow between passageway 221 and annulus 251 through the valves 330' is restricted.

Figure 6A:
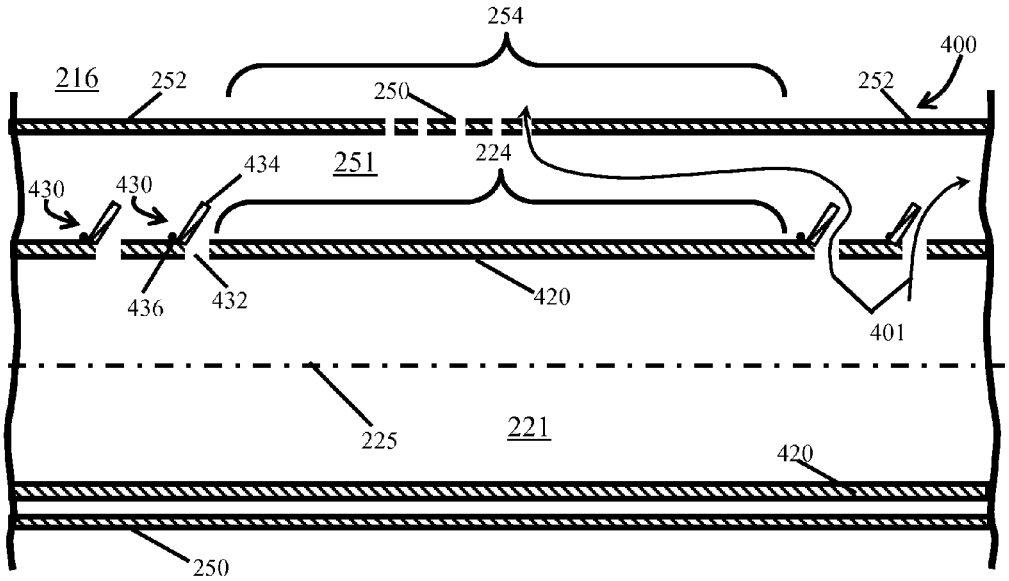
FIGS. 6A and 6B are cross-sectional views of embodiments of the transport tube and packing tube of FIG. 3A along line B-B'.
Figure 6B:
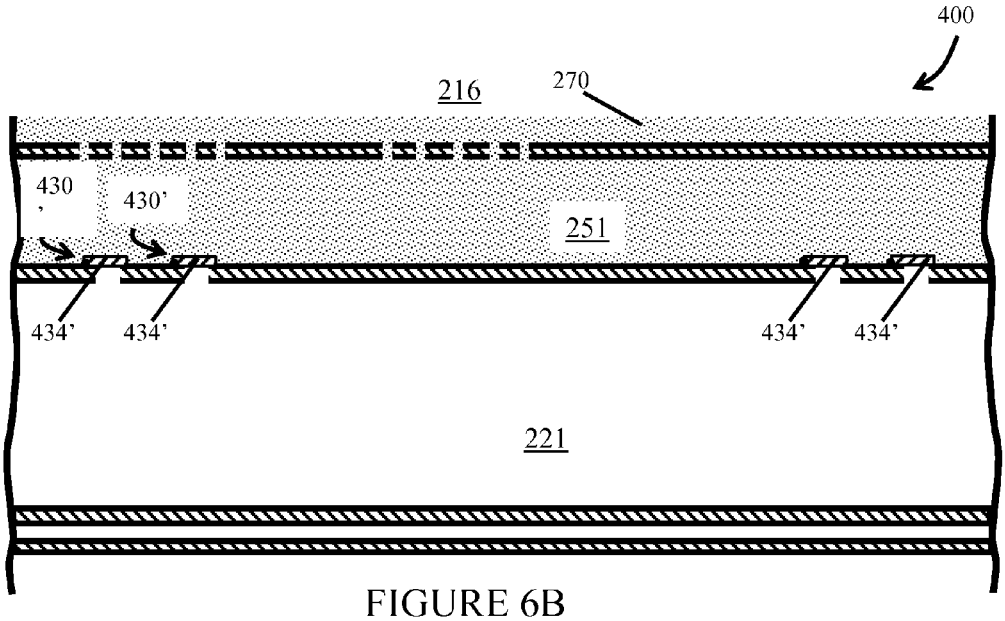

FIGS. 6A and 6B illustrate another embodiment of a shunt tube assembly 400 as shown with a cross-sectional view along line B-B' of FIG. 3A. The shunt tube assembly 400 may be similar to the shunt tube assembly 200 discussed with respect to FIGS. 4A and 4B, and similar parts may not be discussed in the interest of clarity. In this embodiment, the transport tube 420 of shunt tube assembly 400 comprises one or more flapper-type valves 430. The valves 430 may be configured to allow for selective fluid communication between passageway 221 of the transport tube 420 and the annulus 251.

One or more of the valves 430 may comprise an opening 432 that extends through the transport tube 420, allowing for fluid communication between the passageway 221 of the transport tube 420 and the annulus 251. The valves 430 may include a closure member such as a flapper 434 that may be coupled to the transport tube 420 via a spring 436. The flapper 434 may be configured to engage a seat or other sealing surface to substantially restrict flow through the opening 432. In this configuration, the valve 430 may resist fluid flow through the opening 432 in response to a pressure (e.g., fluid pressure force) acting on the flapper 434 in the radially inward direction relative to central axis 225 of the transport tube 420. The spring 436 may be configured to retain the flapper 434 in engagement with the seat or other sealing surface. Upon receiving a pressure acting on the flapper 434 in the radially outward direction that exceeds the force provided by spring 436, the valve flapper may rotate outwards to allow fluid communication between passageway 221 and annulus 251 via opening 432. In the embodiment of FIGS. 6A and 6B, spring 436 may comprise a coil spring, but in other embodiments spring 436 may comprise other types of springs configured to provide a retaining force, such as torsion springs, cantilever springs, a compressed gas, and the like. Depending on the amount of force generated by spring 436, different amounts of fluid pressure acting on flapper 434 may result in actuation of flapper 434.

As slurry flows through passageway 221 and through openings 432 via a flowpath 401, the slurry may collect within annulus 251 and the exterior 216, reducing the pressure differential across the valve 430. As shown in FIG. 5B, when the pressure differential across the valve is less than the biasing force provided by the spring 436, the flapper 434 may be biased into engagement with the seat or other sealing surface to restrict further fluid flow through the valve 430'. This position may be referred to as the closed position of the valve 430'. In an embodiment, the pressure differential across the valve 430 may be reduced sufficiently to allow the valve to close when a volume of slurry gravel is disposed about the valves 430' in the annulus 251 and in the exterior 216, forming a gravel pack within the exterior 216 at that particular location within the wellbore (e.g., wellbore 114 of FIG. 1).

While described in terms of a flapper-type valve, the valves 430 may also comprise any suitable valve configured to provide selective fluid communication between the passageway 221 and the annulus 251. For example, one or more of the valves 430 may comprise a one-way valve such as a check valve, a velocity valve, and the like. In some embodiments, an actuatable valve may be used for one or more of the valves 430. In some embodiments, the closure members may be provided within the slurry. For example, one or more of the valves 430 may comprise nozzles having ball seats, and one or more balls may be included with a fluid (e.g., the slurry) to engage and substantially block flow through the valve 430. The closure members may be retained within the valves by a retaining mechanism, or fluid pressure alone may be used to maintain the closure members engaged with the valves 230. Further, the valves may not form an absolute seal to fluid flow. Some amount of leakage may be acceptable so long as the slurry passing through the passageway 221 does not allow an amount of fluid to pass through the openings and dehydrate the slurry as it passes along the length of the transport tubes.

Figure 7:
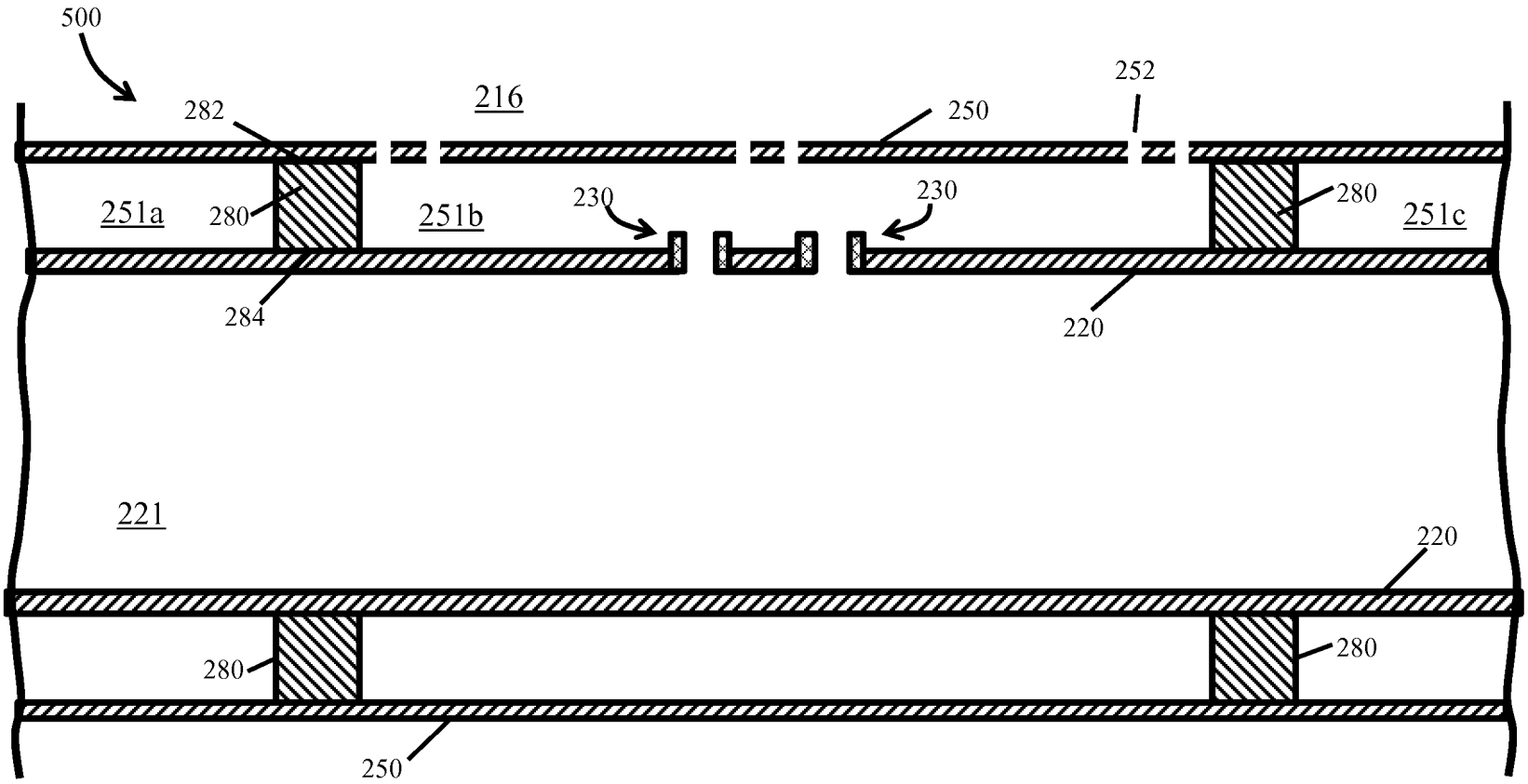
FIG. 7 is a cross-sectional view of an embodiment of the transport tube and packing tube of FIG. 3A along line B-B'.

FIG. 7 illustrates another exemplary embodiment of a shunt tube assembly 500 as shown with a cross-sectional view along line B-B' of FIG. 3A. The shunt tube assembly 500 may be similar to the shunt tube assembly 200 discussed with respect to FIGS. 4A and 4B, and similar parts may not be discussed in the interest of clarity. The shunt tube assembly 500 comprises the transport tube 220 disposed within the packing tube 250, and one or more separator rings 280 disposed between transport tube 220 and the packing tube 250. The separator rings 280 may serve to divide the annulus 251 into a plurality of axially separated sections. In addition, the separator rings 280 may be configured to position the transport tube 220 concentrically or eccentrically within packing tube 250. The separator rings 280 may engage the packing tube 250 at an outer surface 282 and the transport tube 220 at an inner surface 284.

In an embodiment, a plurality of separator rings 280 may provide a plurality of axially separated annulus sections 251*a*, 251*b*, 251*c*. One or more of the valves 230 in the transport tube 220 may be aligned with each of the sections

251*a*, 251*b*, 251*c* to provide fluid communication between the passageway 221 and each of the annulus sections 251*a*, 251*b*, 251*c*. One or more ports 252 may be disposed through the packing tube 250 to provide fluid communication between each of the annulus sections 251*a*, 251*b*, 251*c* and the exterior 216 of the shunt tube assembly 500. Each of the separator rings 280 may engage both the packing tube 250 and the transport tube 220 with a substantially sealing engagement, thereby limiting flow between each of the annulus sections 251*a*, 251*b*, 251*c* through the annulus 251. This configuration may aid in limiting the amount of fluid leakoff through the valves 230 once a section of the wellbore adjacent or near one of the annulus sections 251*a*, 251*b*, 251*c* has been packed.

While the embodiments of the shunt tube assemblies 200, 300, 400, and 500 have been illustrated and described separately, any of these embodiments may be used in any suitable combination. For example, the separator rings of the shunt tubes assembly 500 may be used with any of the embodiments described herein. Further, a shunt tube assembly comprising any of the valves described herein may be used alone or in combination with any of the other valves. For example, all of the valves along the length of a shunt tube assembly may be the same or they may be different.

The screen structure comprising one or more shunt tube assemblies may be formed from individual joints of wellbore tubular. During the formation of the assembled sand screen structure, the shunt tubes on the respective joints are fluidly connected to each other as the joints are coupled together to provide a continuous flowpath for the gravel slurry along the entire length of the assembled sand screen structure during gravel packing operations.

In order to couple joints of wellbore tubulars, adjacent joints comprising screens may be connected by threading together adjacent joints using a threaded coupling (e.g., using timed threads) to substantially align the shunt tubes on the adjacent joints. The end of each shunt tube assembly on the adjacent joints may then be individually coupled using a connector such as a jumper tube. A jumper tube may comprise a relatively short length of tubing which may be engaged to one or more shunt tubes on adjacent joints of wellbore tubulars to provide fluid communication along the length of the shunt tube system. The jumper tubes may comprise one or more tubular components that may be fixed in length or configured to provide a telescoping and extending tubular for engaging one or more shunt tubes.

Typically, the jumper tube may be assembled onto the aligned shunt tubes after the adjacent joints of wellbore tubular are coupled together. In general, jumper tubes may comprise the same or similar shape to the shunt tubes to which they are coupled. In an embodiment, the jumper tube may comprise a pipe-in-pipe configuration to match the shunt tube assemblies to which the jumper tube is coupled. The jumper tube may comprise one or more valves in the transport tube and/or one or more ports in the packing tubes. In an embodiment, the jumper tube may comprise a blank section without any valves or ports, and the jumper tube may serve to provide fluid communication between the transport tube and the packing tube on adjacent joints of wellbore tubular.

In an embodiment, the jumper tube may comprise a single tube and may be configured to provide fluid communication between the transport tubes on adjacent joints of wellbore tubular. In this embodiment, the packing tube on each adjacent joint of wellbore tubular may be terminated or otherwise sealed while providing for a fluid connection between the transport tubes on adjacent sections. The packing tubes may then serve to pack an interval about each joint of wellbore tubular while having a discontinuous annular space (e.g., annulus 251) between adjacent joints of wellbore tubulars.

Once assembled, a screen structure comprising one or more of the shunt tube assemblies described herein may be disposed within a wellbore for use in forming a gravel pack. Referring again to FIG. 1, after the assembled sand screen structure is installed in the wellbore 114, a packing sand/gel slurry can be forced downwardly into the annulus between the casing/wellbore wall and the sand screen to form the pre-filtering sand pack around the screen structure. In the event that an annular sand bridge is created externally around the sand screen structure, the slurry is caused to bypass the sand bridge by flowing into the transport tubes of the shunt tubes assembly, downwardly through the transport tubes, out through one or more valves in the transport tubes, through an annulus between the transport tubes and the packing tubes, out through one or more ports in the packing tubes, and then outwardly into the casing/sand screen annulus beneath the sand bridge. Once the gravel pack has been formed as desired, a fluid may be allowed to flow through the gravel pack, through the slots in the outer body member, through the filter media, and into the throughbore of the wellbore tubular where it may be produced to the surface.

While described in terms of a gravel packing operation, the shunt tube assemblies described herein may also be used with other types of completion and/or workover operations such as fracturing operations, frac-pack operations, acidizing operations, and the like. In some embodiments, the use of the pipe-in-pipe assemblies as described herein may be used to provide fluid flow along the length of the assemblies with an automatic means of restricting flow from the transport tubes to the wellbore when a desired volume of fluid has flown through the one or more valves in the transport tube. This configuration may be useful in ensuring that an entire interval is treated followed by closing the transport tube to flow.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A shunt tube assembly comprising:

a wellbore tubular;

a packing tube;

a transport tube disposed within the packing tube;

an outer body member disposed about and encompassing the packing tube;

at least one valve disposed in a wall of the transport tube that provides selective fluid communication between an interior passageway of the transport tube and an annulus between the transport tube and the packing tube, wherein leakoff of a fluid within a slurry of the shunt tube assembly is prevented from flowing to a formation when the at least one valve is closed, wherein the valve opens into the annulus of the packing tube; and one or more separator rings disposed within the annulus formed between the packing tube and the transport tube, wherein the one or more separator rings are configured to divide the annulus into a plurality of longitudinally spaced annular sections.

2. The shunt tube assembly of claim 1, wherein a central axis of the packing tube is substantially parallel with a central axis of the wellbore tubular.

3. The shunt tube assembly of claim 1, wherein the transport tube is disposed substantially concentrically within the packing tube.

4. The shunt tube assembly of claim 1, wherein the transport tube is disposed eccentrically within the packing tube.

5. The shunt tube assembly of claim 1, wherein the packing tube comprises one or more ports.

6. The shunt tube assembly of claim 1, wherein the at least one valve comprises:

a tubular wall; and a bore defined by the tubular wall, wherein the tubular wall comprises a swellable material configured to swell when contacted with a suitable fluid.

7. The shunt tube assembly of claim 6, wherein the at least one valve further comprises a coating disposed on a surface of the swellable material.

8. The shunt tube assembly of claim 6, wherein the swellable material is configured to substantially restrict flow through the bore in response to being contacted by the suitable fluid.

9. The shunt tube assembly of claim 1, wherein the at least one valve comprises:

a closure member, wherein the closure member is configured to substantially block flow through an opening in a closed position and allow flow through the opening in an open position.

10. The shunt tube assembly of claim 9, wherein the at least one valve is configured to provide fluid communication between the transport tube and the packing tube until pressure difference across the at least one valve falls below a threshold.

11. The shunt tube assembly of claim 1, wherein the one or more separator rings are configured to substantially prevent fluid communication between adjacent annular sections.

12. A method of gravel packing comprising:

passing a slurry through a transport tube disposed within a packing tube and an outer body member, wherein the outer body member is disposed about and encompasses the packing tube, wherein the transport tube, the packing tube, and the outer body tube member are disposed within a wellbore annulus defined between an inner wellbore tubular and a wellbore wall;

passing the slurry from the transport tube directly into at least one annular section of a packing tube annulus formed radially between the transport tube and the packing tube and longitudinally by one or more separator rings, wherein the slurry passes through at least one valve disposed in the transport tube when passing from the transport tube to the annulus;

closing the at least one valve to prevent leakoff of a fluid within the slurry flowing to a formation; and disposing the slurry about a sand screen assembly.

13. The method of claim 12, further comprising: restricting fluid flow through the at least one valve after passing at least a portion of the slurry through the at least one valve.

14. The method of claim 13, wherein restricting the fluid flow comprises:

allowing a swellable material to contact a suitable fluid;

swelling the swellable material in response to contacting the fluid; and reducing a flow area through the at least one valve based on swelling the swellable material.

15. The method of claim 13, wherein restricting the fluid flow comprises:

reducing a pressure differential across the at least one valve; and engaging a closure member with a seat in response to reducing the pressure differential, wherein the closure member substantially prevents flow through the at least one valve when engaged with the seat.

16. The method of claim 13, wherein passing the slurry from the transport tube to the annulus comprises passing the slurry through a second valve disposed in the transport tube after restricting fluid flow through the at least one valve.

17. The method of claim 12, wherein passing the slurry from the transport tube to the annulus comprises:

passing the slurry from the transport tube to a first annular section through the at least one valve;

restricting flow through the at least one valve; and passing the slurry from the transport tube to a second annulus section through a second valve.

18. A method comprising:

passing a fluid through a transport tubular disposed within a packing tube, wherein an outer body member is disposed about and encompasses the transport tubular and the packing tube, and wherein the transport tubular, the packing tube, and the outer body member are disposed within a wellbore annulus defined between an inner wellbore tubular and a wellbore wall;

passing the fluid from the transport tubular directly into at least one annular section of an annulus formed radially between the transport tubular and the packing tube and longitudinally by one or more separator rings via at least one valve disposed in the transport tubular;

passing the fluid from the annulus to an exterior of the tubular within the outer body member via one or more ports disposed in the packing tube; and closing the at least one valve in response to a portion of the fluid passing through the at least one valve.

* * * * *